United States Patent [19]

Brock

[11] 4,017,012

[45] Apr. 12, 1977

[54] SEVERING APPARATUS FOR PLASTIC MATERIAL

[76] Inventor: Reginald L. Brock, Rte. 44, Salisbury, Conn. 06068

[22] Filed: Nov. 25, 1974

[21] Appl. No.: 526,467

Related U.S. Application Data

[62] Division of Ser. No. 366,734, June 4, 1973, Pat. No. 3,877,625.

[52] U.S. Cl. ..... 225/96.5; 225/4; 225/103; 83/171

[51] Int. Cl.[2] ..... B26F 3/00

[58] Field of Search ..... 225/1, 2, 4, 94, 96.5, 225/96, 103; 83/8, 51, 171, 566; 264/157, 159, 160

[56] References Cited

UNITED STATES PATENTS

| | | | |
|---|---|---|---|
| 1,706,227 | 3/1929 | Gray | 83/11 |
| 2,334,940 | 11/1943 | Tourneau | 225/103 |
| 2,789,640 | 4/1957 | Belden | 225/4 X |
| 2,997,905 | 8/1961 | Larson | 83/171 |
| 3,757,627 | 9/1973 | Lange | 83/51 X |
| 3,821,911 | 7/1974 | Seme | 83/8 X |

*Primary Examiner*—Leon Gilden
*Attorney, Agent, or Firm*—Parmelee, Miller, Welsh & Kratz

[57] ABSTRACT

A positive acting apparatus or machine is disclosed having an upper, downwardly movable blade assembly and a lower fixed position opposed blade assembly for cutting-off selected lengths of a resin or plastic sheet-like material. Fluid motors are employed for raising and lowering the upper blade assembly, and rack and gear means is provided for assuring that both end portions of the assembly move in exact synchronism. The upper blade is aligned with and operated on the same vertical plane as the lower blade, and means is provided for stopping downward movement of the upper blade when it approaches close adjacency with but before it engages the lower blade. Electrical heating elements extend longitudinally along the blade assemblies and are energized to maintain the blades at a raised temperature during their applicatin to the material. A withdrawal of the upper blade assembly after its downward stroke causes the under-engagement of an ejector with the main body of the material to move it upwardly with respect to and off the lower blade. Later, the advance portion of the material is severed from the main body by breaking the sheet at the line of previous blade action.

20 Claims, 9 Drawing Figures

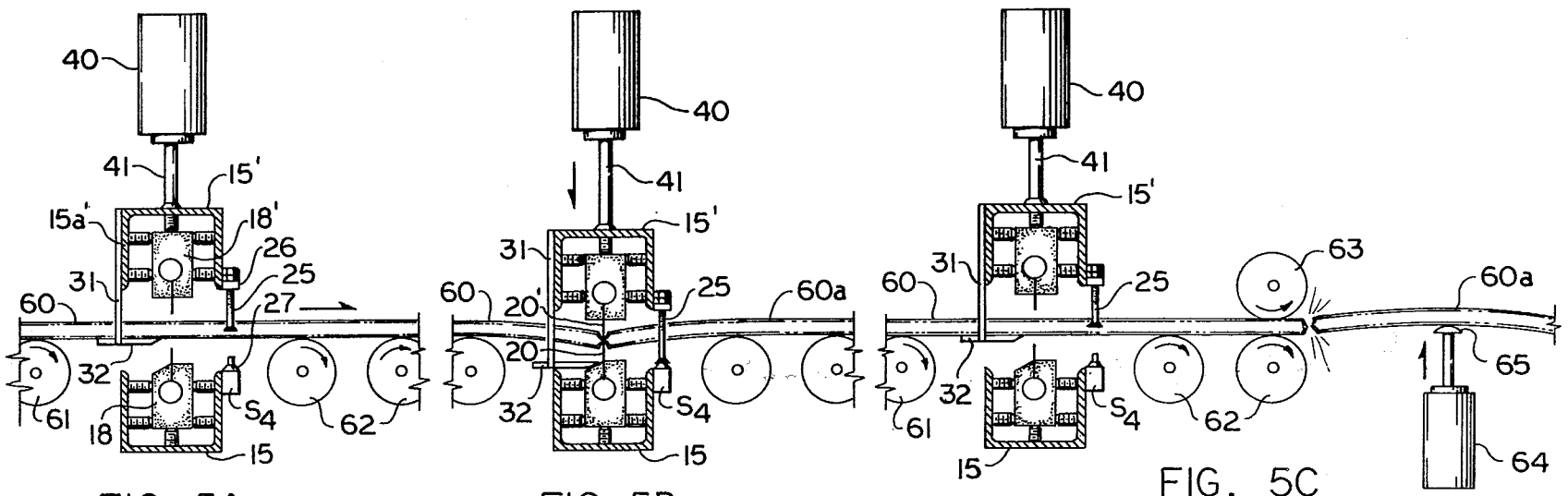
FIG. 5A
FIG. 5B
FIG. 5C
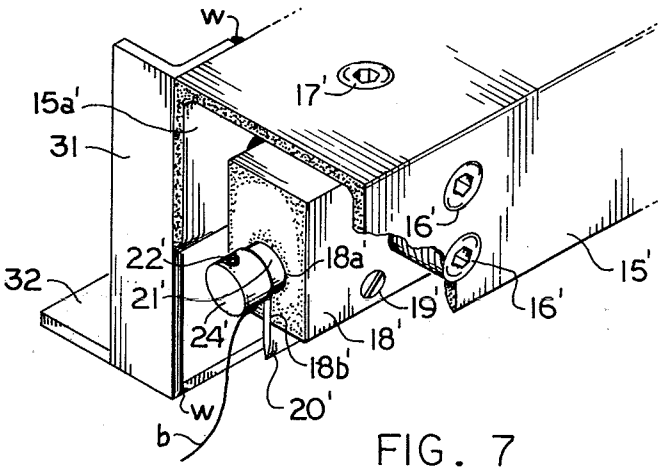
FIG. 7
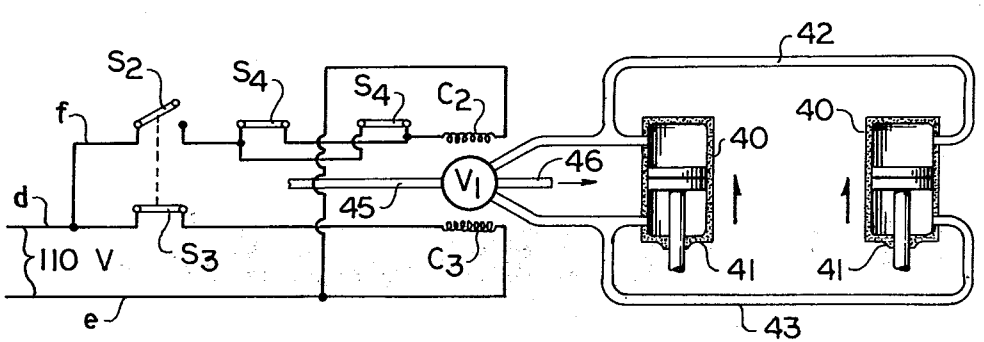
FIG. 6

SEVERING APPARATUS FOR PLASTIC MATERIAL

This application is a division of our application Ser. No. 366,734, now U.S. Pat. No. 3,877,625 entitled "Severing Procedure and Apparatus for Plastic Material" filed June 4, 1973.

BACKGROUND OF THE INVENTION

1. Field of the Invention

This invention relates to a new and improved apparatus for severing or cutting-off lengths of plastic or resin material from a continuous strip or sheet and, particularly, to a machine or process whereby a cutting-off operation may be effectively accomplished without damaging the material.

2. Description of the Prior Art

There have been two conventional methods of cutting plastic or resin sheet material into suitable lengths as it is extruded. A hydraulic shear has been used for relatively tough and heavy sheet material, such as a polycarbonate. This method, however, is not satisfactory for a sheet of resin in the nature of an acrylic or polystyrene since it tends to cause a shattering of its edges. The usual method of cutting the latter type of resin is to employ a traveling cut-off saw, but this has several disadvantages. In the first place, it generates a considerable amount of sawdust which contaminates air in the room and adheres to the sheet, causing a cleaning problem. In the second place, the sawing operation takes a measurable period of time to cut across the width of the material, and makes it difficult to maintain an absolutely square cut. Finally, the saw is extremely noisy and represents a problem of ear damage to employees working in the area for long periods of time.

There has been a need for an improved cutting-off method, machine or apparatus which will have the ability to substantially simultaneously cut-off the full width of a piece of material, that will be effective for various types of resin or thermoplastic materials, that will assure a full length accurate cut, and that will eliminate health hazards and loss of time that exist in connection with the use of a traveling saw.

SUMMARY OF THE INVENTION

In view of the above considerations, it has been an object of the invention to devise new and improved procedure for effectively and efficiently cutting-off pieces from a continuous length or body of resin sheet or strip material.

Another object of the invention has been to develop new and improved apparatus for cutting across the full width of resin or plastic material.

Another object has been to eliminate disadvantages and limiting features of prior procedure and apparatus for severing plastic or resin material.

A further object of the invention has been to develop apparatus for cutting across the full width of various types of resin or plastic materials without damaging them or giving rise to an uneven type of cut.

These and other objects of the invention will appear to those skilled in the art from the illustrated embodiments and the claims.

BRIEF DESCRIPTION OF THE DRAWINGS

FIGS. 5A, 5B and 5C represent, somewhat diagrammatically, steps in a process of the cutting-off pieces or lengths of sheetlike resin material, employing a process and apparatus of the invention.

FIG. 5A is representative of the positioning of upper and lower blade assemblies shown in the left hand portion of FIG. 1, wherein a body of the material is being advanced endwise through a transverse mouth of the apparatus by suitable means such as rolls.

FIG. 5B shows the positioning of cutter blade or knife assemblies represented by the right hand portion of FIG. 1, wherein the two blades have advanced to a close, non-abutting adjacency to simultaneously hot-cut across the full width of a length of material; in this view, the upper blade assembly is in its "down" or cutting position and an ejector blade or guide member carried thereby has moved downwardly out of a supporting relation with respect to the material. The advancing movement of the material has been stopped during this cutting-off operation.

In FIG. 5C the upper cutting blade assembly has been raised until the ejector blade is in an under-supporting position with respect to the advancing end portion of the main body of the resin material to thus lift the material off the bottom blade and complete the blade-to-material separation along sticky score lines, groove-like indentations or recess lines. Also, the sheet material is advanced to a separating station at which the forward piece is broken-off or completely separated from the main body at the cut line area.

FIG. 6 is a schematic diagram showing electrical means for controlling the operation of pneumatic cylinders or fluid motors that are employed to lower and raise the upper cutting blade assembly. The motors in the position shown have started to raise the assembly from a cutting-off position.

Figure 2:
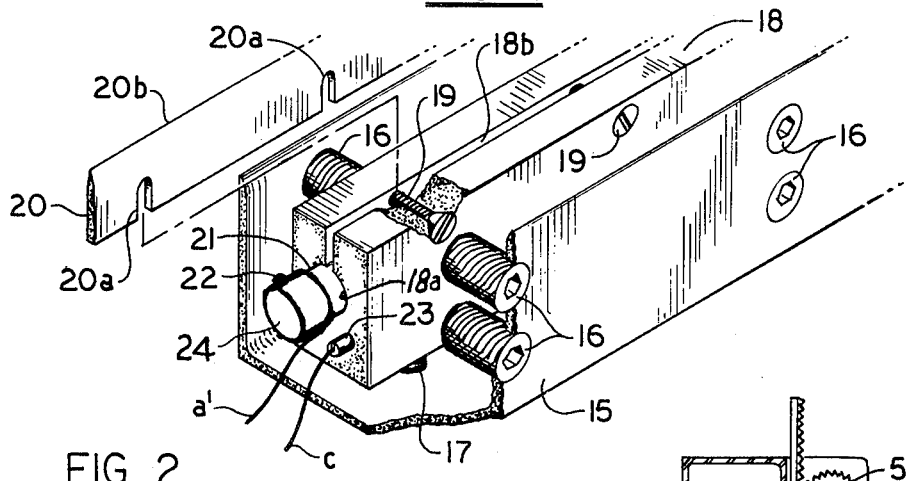
FIG. 2 is a greatly enlarged, exploded perspective detail in elevation and partial section showing the construction of a lower or fixed cutting blade assembly.

And, FIG. 7 is a fragmental end perspective on the enlarged scale of FIG. 2, particularly illustrating the construction of the upper or reciprocating cutting blade assembly.

DESCRIPTION OF THE PREFERRED EMBODIMENT

Figure 1:
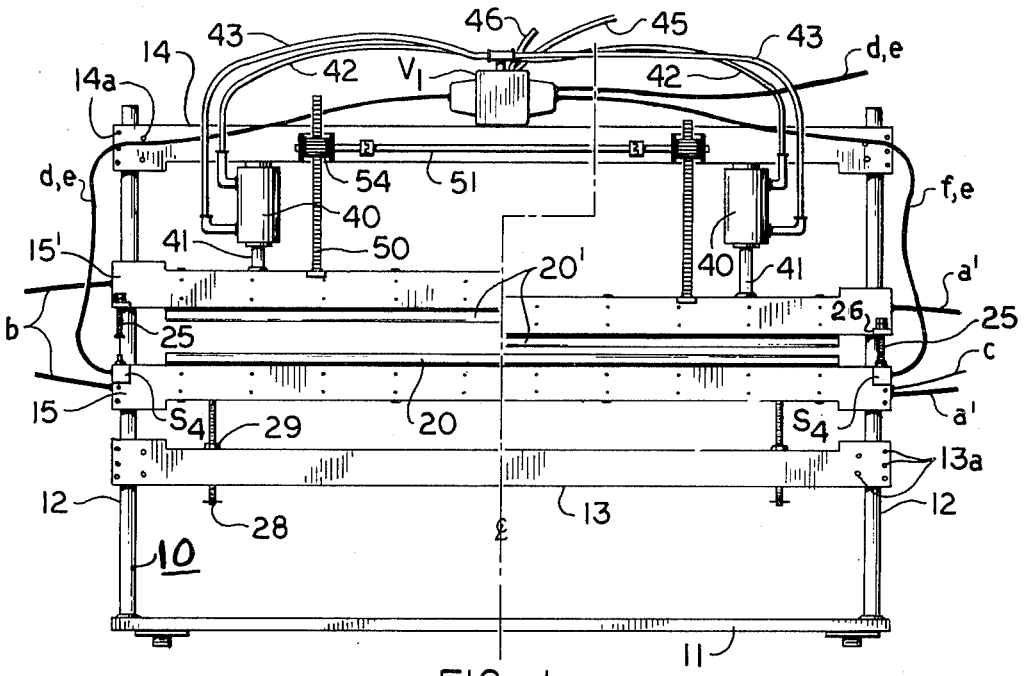
FIG. 1 is an end view in elevation of a representative cutting-off machine constructed in accordance with the invention; the left hand portion of the figure shows a movable cutting blade assembly in an upper or inoperative position, while the right hand portion shows the blade assembly in a final "down" or cutting position (the distance between the blades is exaggerated in this showing).

Referring to FIG. 1, a cutting-off machine or apparatus 10 is shown as having a rectangular frame structure defined by a cross-extending, fixed-position, channel-shaped, lower connecting member 11, a pair of cylindrical, transversely spaced-apart, upright column members 12, an intermediate, fixed-position, channel-shaped, connecting member 13, and a cross-extending, fixedly mounted, channel-shaped, upper connecting member 14. A normally fixedly positioned, cross-extending, channel-shaped member 15 (see also FIG. 2) is adapted to be adjusted as to its position along the columns 12 by means of a pair of threaded bolts or pins 28 that extend upwardly from the intermediate cross member 13. The adjusted position of each pin 28 is retained by a nut 29.

To simplify the showing and description, similar parts for the lower and upper cutting blade assemblies have been provided with the same reference numerals, but parts of the upper assembly have been designated by prime suffixes. A cross-extending, blade-supporting head member 18 is centrally adjustably mounted within the channel-like member 15 by means of transversely spaced-apart, horizontally, through-extending, side-mounted, Allen head screws 16 and transversely spaced-apart vertically positioned Allen head screws 17. As particularly shown in FIG. 2, the screws 16 and 17 enable the head member 18 to be accurately aligned with a corresponding head member 18' of the upper cutter blade assembly (see FIG. 7).

A temperature-sensitive metal insert element 23 is shown positioned to extend within one end of the head 18, and a suitable electrical heating element, such as a Calrod element 21, is shown positioned to extend fully from end to end of the head member 18, within a centrally disposed, fully extending bore **18*a* therein. Each end of the heating element 21 has an electric connector metal cap 24 of a suitable material, such as of brass, secured thereon as by a set screw 22. One cap 24** is connected to one electrical lead *a'*, while the other cap 24 is connected to an opposite electrical lead *b* (see FIG. 4). The upper side of the head 18 has a longitudinally extending, open-end slot **18*b* therein which is adapted to receive a suitable metal cutting blade 20 therein. As shown in FIG. 2, the blade 20 has an upper cutting edge portion 20*b* and a series of spaced-apart mounting slots 20*a* that are open to its bottom edge and that are adapted to fit over and receive a group of transversely spaced-apart, flush-head, through-extending mounting screws 19. Each screw 19 (as shown in FIG. 2) has a threaded mounting between the lips of the upper side of the head to flex them together and provide a tight gripping action on the blade 20 when it is positioned in the slot 18*b***.

The upper blade assembly, as particularly shown in FIG. 7, is generally of the same construction as the lower blade assembly, except that channel support member 15' of the upper blade, in addition carries an ejector blade or plate member 32 which extends along the full length extent of the upper assembly, behind the blade 20'. The ejector blade 32 is suspended from a back flange wall **15*a'* of the channel member 15' by a pair of legs 31 which extend downwardly adjacent each end of the member 15'. The pair of end-positioned legs 31** are secured by weld metal *w* between the back wall **15*a'* and opposite ends of the ejector blade 32. If as shown, the members 31 are of angle shape, then one leg flange which lies along the wall 15*a'* is slightly shorter than the other flange leg so as to rest upon the upper face of the ejector blade 32.**

Figure 3:
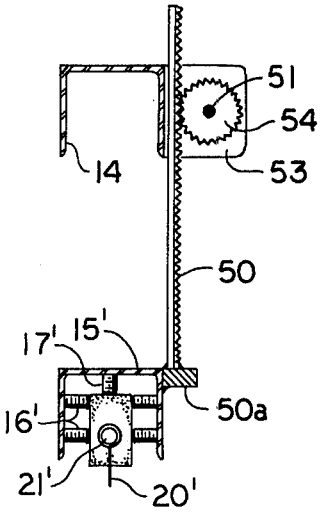
FIG. 3 is a side sectional view in elevation of an intermediate scale, particularly illustrating the construction of an upper blade assembly and means for assuring movement of its end portions in a fully horizontally aligned relationship.

Referring to FIGS. 1 and 3, the cross-extending channel member 15', is, at its ends, journaled for "up" and "down" movement on the columns 12. A pair of fluid motors or pneumatic cylinders 40 have their housings secured to the upper frame member 15 and have forward ends of their piston rod assemblies 41 secured to an upper face or web wall of the member 15' to extend upwardly therefrom. See also FIGS. 5A to 5C. Motors 40 constitute the actuating means for raising and lowering the upper cutting blade assembly.

To assure an aligned movement of the upper blade assembly, a suitable means such as rack gear means may be provided. In this connection, a rack 50 (see also FIG. 3) is shown secured at its lower end to a front ledge portion **50*a* which projects from the upper channel 15'. A bifurcated mount 53 is weld-secured to project forwardly from the upper channel-shaped frame member 14 to receive and journal one end of a cross-extending connecting shaft 51 on which a gear wheel 54 is secured for rotation therewith. Each gear 54 meshes with an associated rack 50 in such a manner that upper and lower movement of the pair of racks 50 is accomplished in step to maintain a horizontally aligned movement of the cutter blade 20' and assures a full width of uniform, cross, cutting-off action on a body length of resin or plastic sheet material 60** that is being severed.

To assure that a uniform depth of penetration of the blades 20 and 20' across the plastic or resin sheet material or body 60 is accomplished, two micro switches $S_4$ are provided adjacent opposite ends of the apparatus. The movable support channel 15' that carries the cutter assembly at each end also has an adjustable limit pin 25 that extends downwardly from a mounting lug 26. Each limit pin 25 is adapted to engage and push-in an operating pin or button of and open each of the normally-closed switches $S_4$ that thus de-energize solenoid $C_2$ and cut-off positive fluid pressure fluid through line 42 to upper ends of the motors 40 at the end of the "down" stroke. Due to the parallel connected relation of the switches $S_4$ (see FIG. 6), both must be pushed-in by an associated pin 25 to an "open" position before the solenoid $C_2$ is de-energized. As a further protection, each switch $S_4$ has a mechanical abutment or stop portion 27 (see FIG. 5A) which, when engaged by an associated pin 25, acts as a positive stop to prevent any possibility of direct engagement between fully vertical blades 20 and 20'.

Figure 4:
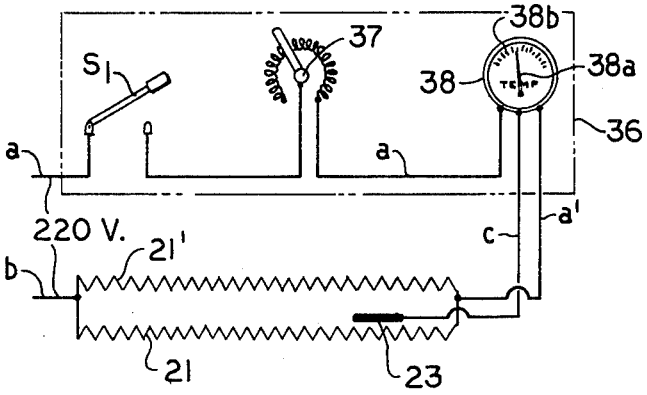
FIG. 4 is an electrical circuit diagram illustrating a suitable system for heating upper and lower blade assemblies and for indicating and controlling the temperature of blades of the assemblies.

FIG. 4 discloses a suitable circuit arrangement for energizing and controlling the temperature of the blades 20 and 20'. In this figure, *a* and *b* represent input terminals from a source of 220 volts, A.C., with the one terminal *b* being connected to one terminal of each of the heating elements 21 and 21', and with the other terminal *a* being connected through a switch $S_1$, a rheostat 37 and a temperature indicating unit 38 to the other terminal of each of the elements 21 and 21' through line *a'*. It will be noted that the two heating elements 21 and 21' are connected in parallel so that they receive the same amount of energization. Temperature-sensitive element 23 may (as shown in FIG. 2) be carried by the head 18 of the lower cutting blade assembly, and has a lead *c* to the unit 38 to indicate through the agency of a finger **38*a* and a temperature scale 38*b*, the exact temperature of the head. The unit 23 may be of a conventional type such as used for the oven of an electric stove. Thus, the operator can adjust the amount of current being supplied through the agency of rheostat 37** so as to maintain the upper and lower cutting blade at a requisite resin-softening, score-line producing temperature which, for a typical resin material, such as a polystyrene or an acrylic sheet, may be within a range of about 400° to 500° F. It will be appreciated that the apparatus is constructed primarily for a so-called thermoplastic type of resin material, since the heating-melting of the immediate cutting line is an essential part of the operation. It has been found that the provision of blade temperatures that are sufficient to melt or soften the particular resin involved is the criterion.

Referring to FIGS. 1 and 6, an operating circuit is shown for the pair of motors 40 which includes a source of 120 volts A.C., as supplied to terminals *d* and *e*. The line *d* is shown connected through a switch contact $S_3$ to one terminal of a valve-controlling solenoid coil $C_3$. A branch connection or line *f* from line *d* is shown connected through a switch $S_2$ and switches $S_4$ to one terminal of a second valve control solenoid coil $C_2$. The other terminals of the solenoids $C_2$ and $C_3$ are connected to the line *e*. The switches $S_2$ and $S_3$ have a common mechanical interlock, so that when one is open, the other must be closed. Parallel connected switches $S_4$ in the line *f* leading to the one side of the solenoid $C_2$ assure that these normally closed switches do not interrupt energization of such solenoid until both of them are opened, as by the simultaneous pushing-in movement of their pin ends by the stop pins 25 in the manner shown in FIG. 5B.

A three-way control valve $V_1$ has its input connected through a positive fluid or air pressure source line 45, has an exhaust line 46, and a pair of fluid or air flow operating lines 42 and 43. It will be noted that the fluid line 42 is connected to the upper ends of the chambers of the motors 40, while fluid line 43 is connected to the lower ends of the chambers of the motors. The valve $V_1$, of conventional construction, is normally retained, as by spring means, in a closed position whereby fluid from the source line 45 is shut-off. When the solenoid $C_2$ is energized, this causes the valve $V_1$ to move to a position wherein positive pressure fluid is flowed from the source line 45 into the line 42 to cause the piston rod assemblies 41 to move downwardly or forwardly. At this time, the line 43 is connected through the valve $V_1$ to the exhaust line 46. On the other hand, when the coil $C_2$ is de-energized and the coil $C_3$ is energized, the valve $V_1$ connects the source line 45 to the line 43 to thus apply positive fluid pressure to the lower or front ends of the motors to cause their piston rod assemblies 41 to move upwardly. At this time, the valve $V_1$ connects the line 42 to exhaust line 46.

In the operation of the machine, it will be apparent that commercial automatic controls may be utilized for the switch means $S_2$ and $S_3$. Also, the unit 38 may be a commercial controller which will include a current control means that will take the place of rheostat 37 for automatically maintaining the electrical heating units 21 and 21' at any desired temperature as set on a scale carried by the unit. Also, the switch means $S_2$, $S_3$ may be controlled by a timing means, by a sheet roller that operates on the basis of a desired length of material that passes thereover, or by a scanning means. However, such means is not a part of the invention and, for this reason, a simple mechanical type of control has been illustrated in FIG. 6. It will be appreciated that the temperature used may be varied for the type of material involved, and also to adjust for different thicknesses of the material. In other words, a 400° F. temperature is sufficient for a thickness of an acrylic or styrene sheet up to, for example, ⅛ inch, while an intermediate 450° F. temperature up to 500° F. temperature may be used for greater thicknesses, taking into consideration the limited time that the cutting blades contact the material.

A range between high and lower limits of the temperature of about 100° F. has been found to be sufficient in this connection, with the governing temperature being determined by the temperature at which the particular resin material will melt upon the application of cutting edges **20*b* of the blades. In FIGS. 5A to 5C, suitable material advancing rolls, such as aluminum rolls, are shown spaced along the operating line. Rolls 61 and 62 serve (as shown in FIG. 5A) to advance a continuous body of material 60 to a cutting-off position or station. At cutting or groove-forming station of FIG. 5B, movement of the body of material 60 may be stopped while the pistons 40 lower the upper channel 15', the head 18 and the cutter blade 20' into opposed cutting-in, recess or groove-forming cooperation with the lower cutter blade 20. The sharp, hot blades 20 and 20' are driven into the plastic or resin sheet evenly across its full width to form cut-in recess or groove line portions that are somewhat sticky at the point or line of score. The upper blade 20' may be then withdrawn; its ejector blade 32 engages the underside of the material to lift it off the lower blade 20. The body of material 60 may be advanced along with the still-connected forward piece 60*a* for about 12 to 18 inches on the rolls 61 and 62 (see FIG. 5C) to a position at which the line of cut has reached an upper, backup roll 63. At this time, the plastic or resin material is now cooled along the line of cut, and the piece 60*a* may now be completely separated from the main body 60 by a breaking action. In FIG. 5C, the breaking action is shown being accomplished by a cooperative "up" movement of a push head 65 of a fluid or air motor 64 and a position-holding action of an upper roller 63. The upwardly flexed piece 60*a* then returns to its normal planar shape and may be removed to a place of use or storage. As shown in FIG. 5B, since the blade 20 is stationary, the blade 20' is employed to, as shown, flex the body length of material 60 under the forward or down pressure of such blade into recess-forming engagement with the edge of the stationary blade 20**. The extent of the movement is, as shown, controlled to provide an equalized depth of line recess formation in opposite side faces of the material, as effected by the relative movement of the blades, with a relatively thin central thickness of the material being retained.

As indicated by the arrows of FIGS. 5A, 5B and 5C, the body of material may be positively advanced to each station by rolls or rollers 61, 62 and 63 and, after the line recess portions have had an opportunity to cool, may be positioned within a roll pass defined by a group of rollers and particularly, by aligned roll pair 62, 63 (see FIG. 5C) during the final breaking or severing operation.

I claim:

1. A resin severing apparatus for effecting an improved severance of successive individual pieces from a sheet-like body length of solidified thermosplastic resin material which comprises, a frame, a pair of opposed blades operatively carried by said frame and defining a pass for the body length, means for moving one blade of said pair into engagement with the material of the body length and flexing it into engagement with the other blade at the pass and for then simultaneously applying said pair of blades in the same plane inwardly with aligned cutting-in blade pressure and melting heat along lines of blade engagement fully across opposite sides of the body length to form opposed aligned line recesses therein, means carried by said frame for positively limiting the relative forward movement of said blades to a slightly separated fully in-line relation to complete the application of cutting-in blade pressure and retain a relatively thin transverse thickness portion between the line recesses, means for thereafter withdrawing the blades relative to each other to release the body length, and means for advancing and cooling the material along the line recesses and for thereafter severing a forward end portion of the body length along the full extent of the thin transverse thickness portion.

2. Apparatus for enabling an improved severance of individual pieces from a sheet-like body length of solidified thermoplastic resin material which comprises, a frame, a pair of blades operatively carried by said frame and defining a pass for the material, means for relatively moving said blades forwardly in the same plane into substantially evenly applied, opposed, aligned lines of engagement across opposite sides of the material, means for simultaneously applying cutting-in blade pressure and melting heat along the lines of blade engagement across the material to form opposed aligned recesses on opposite sides of the material, means for positively limiting the relative forward movement of said blades to a slightly separated fully in-line relation to complete the application of the cutting-in blade pressure upon the material and retain a relatively thin transverse thickness portion between the line recesses, means for withdrawing the blades relative to each other to release the material, means for advancing and cooling the material along the line recesses and for thereafter severing the material along the full extent of the thin transverse thickness portion in alignment with the line recesses, and supporting means for the body length of material adapted to be advanced forwardly with one blade of said pair out of a supporting position with respect to the material and to be retracted backwardly with the withdrawal of said one blade relative to the other blade into a supporting position with respect to the material.

3. Apparatus for accurately severing individual pieces from a body of resin material which comprises, a support frame, a pair of cutting blades operatively carried by said frame and defining a scoring pass for the material, means for heating said blades to a resin-melting temperature, means for relatively moving said blades towards each other into a material flexing and an opposed cutting-in resin-forming engagement with opposite sides of a length of material introduced into the pass defined thereby and for relatively moving said blades away from each other, a cross-extending head for each of said blades, a cross-extending hollow support member for each of said heads, one of said hollow support members being movable and journaled for forward and backward movement along said frame and with respect to the other support member, each of said blades being vertically and horizontally adjustably mounted within an associated support member for aligning the blade carried thereby in a substantially exact and fully opposed alignment with the blade carried by the other of said heads, a pair of fluid motors carried by said frame, each of said fluid motors having a piston rod secured adjacent one end of said movable support member for actuating it, rack and gear means operatively carried by said frame and connected to opposite end portions of said movable support for maintaining a fully synchronous movement of said support member and the associated head and blade carried thereby during its actuation by said pair of fluid motors, said movable support member having a foot portion for guidably supporting the body of resin material during advancing movement thereof into and through the pass, said foot portion being adapted to be moved out of supporting engagement with the body when said movable support member is advancing its associated blade into a cooperating cutting-in relation with respect to the blade of said other support member, and said foot portion being suspended by said movable support member for engagement with the body of material to move it relatively to the pass when said movable head is moving its associated blade out of close adjacency with the other blade.

4. Apparatus for accurately severing individual pieces from a body of resin material which comprises, an upright support frame, a pair of cutting blades operatively carried by said frame and defining a cutting pass for the material, means for heating said blades to a resin-melting temperature, means for relatively moving said blades towards each other into an opposed cutting-in recess-forming engagement with and fully across opposite sides of a length of the material introduced into the pass defined thereby and for relatively moving said blades away from each other, a lower fixed head and an upper movable head positioned on said frame, one of said cutting blades being respectively carried by each of said heads, heating means also carried by each of said heads, said means for relatively moving said blades being connected to said upper head to move it towards and away from said lower head and to flex material into recess cutting-in alignment between said pair of blades, thermostat means for controlling the temperature of said heat applying means, said means for moving said upper head being a fluid motor means mounted on said support frame, means for automatically de-energizing said motor means when said movable head has advanced its said cutting blade into close edgewise adjacency with the other of said blades, and means for applying melting heat being electrical heating elements carried by said blades, thermosensitive indicator means carried by said blades for indicating the operating temperature thereof, and means for adjusting the electrical energization of said heating elements in accordance with the reading of said indicator means.

5. Apparatus as defined in claim 4 wherein, said means for moving said movable head is a pair of fluid motors positioned on said frame and operatively connected to said movable head, and tie means operatively connects opposite end portions of said movable head to assure an equal inward movement of the blade carried thereby into an accurately aligned inward position with respect to the blade carried by said fixed head.

6. Apparatus for accurately severing individual pieces from a body of resin material which comprises, a support frame, a pair of cutting blades operatively carried by said frame and defining a scoring pass for the material, means for heating said blades to a resin-melting temperature, means for relatively moving said blades towards each other into a material flexing and an opposed cutting-in recess-forming engagement with opposite sides of a length of the material introduced into the pass defined thereby and for relatively moving said blades away from each other, one of said blades having means actuated during movement of said blades away from each other to move the material off the other of said blades, and said means for relatively moving said blades being carried by said support frame and operatively connected to move one of said blades towards and away from the other of said blades.

7. Apparatus as defined in claim 6, wherein, an ejector blade is carried by said frame and is adapted to engage the material and move it off said other blade simultaneously with movement of said movable blade away from said other blade after the forming of the line recesses in the material.

8. An in-line resin severing apparatus for progressively effecting an improved cross severance of individual pieces from forward end portions of a sheet-like body length of solidified thermoplastic resin material which comprises, means for endwise-forwardly advancing the body length of material, a support frame in a cooperative in-line position with respect to said advancing means, movable and fixed blades defining a pair of cutting blades carried by said frame and defining a recess-forming pass therebetween for the body length, means operatively carried by said frame for relatively moving said pair of blades towards each other on a cross-extending plane into opposed inward lines of engagement with opposite sides of a forward end portion of the body length at the pass, means for simultaneously applying opposed cutting-in blade pressure and melting heat at the pass to the body length along the lines of blade engagement for forming aligned line recesses fully across opposite sides thereof, means for positively limiting the relative movement of said blades towards each other to a slightly separated fully aligned engaging relation within the body length to complete the application of cutting-in blade pressure and retain a relatively thin transverse thickness portion fully across the opposite sides of the body length between the line recesses, means for relatively withdrawing said blades with respect to each other and for releasing them from engagement with the body length, means for advancing the body length in-line from the recess-forming pass and cooling it along its line recesses, and separating means in an in-line advanced position with respect to the recess-forming pass for engaging the body length and flexing it adjacent its line recesses to break-off the thin thickness portion thereof and complete separation of the forward end portion from the body length thereat.

9. An in-line apparatus as defined in claim 8 wherein said separating means has a pair of means engaging opposite sides of the body length and has closely adjacent means for flexing the body length between said pair of means.

10. An in-line apparatus as defined in claim 8 wherein said means for positively limiting the relative movement of said blades towards each other is operatively carried by said support frame and connected to one of said blades.

11. In an in-line apparatus as defined in claim 8 wherein, said separating means has a pair of rolls positively gripping opposite sides of the body length adjacent its line recesses, and said separating means has means for flexing the forward end portion of the body length adjacent the thin thickness portion thereof when the thin thickness portion is in an adjacent endwise-forward position ahead of said pair of rolls.

12. An in-line apparatus as defined in claim 8 wherein means is operatively carried by said frame and cooperating with said pair of blades to effect the recess-forming operation uniformly in depth across the full width extent of opposite sides of the body length at the recess-forming pass.

13. An in-line apparatus as defined in claim 8 wherein, said separating means includes a pair of opposed rolls moving in the direction of in-line advance of the body length, and means cooperates with said pair of rolls to flex the body length out of alignment with respect to its in-line direction of advance.

14. An in-line apparatus as defined in claim 8 wherein, said fixed one of said blades is mounted in position on said frame, and a head is opperatively carried by said frame to carry the other of said blades and move it into and out of a recess-forming position with respect to said fixed blade.

15. An in-line apparatus as defined in claim 14 wherein blade means is adapted to engage the body length adjacent said recess-forming pass upon the completion of the forming of the aligned line recesses thereacross for moving the body length off said fixed blade.

16. An in-line apparatus as defined in claim 15 wherein said blade means is connected to said head for movement with said other blade.

17. Apparatus for enabling an improved severance of individual pieces from a sheet-like body length of solidified thermoplastic resin material which comprises, a frame structure, a pair of blades carried by said frame structure and defining a scoring pass therebetween for the material, means for heating each of said blades to resin melting temperature, means for relatively moving said blades towards and away from each other into and out of scoring engagement across opposed lines on the material to form line recesses on opposite sides of the material, means for positively limiting the relative inward movement of said blades with respect to each other to a slightly separated fully aligned relation within the material while retaining a relatively thin transverse thickness portion therebetween, means for thereafter withdrawing said blades with respect to each other and for releasing the material from engagement therebetween, means for supporting the material while advancing it into the pass between said pair of blades, means for thereafter releasing said supporting means during relative movement of said blades into a scoring position with respect to the material, means for returning said supporting means to a supporting position with respect to the material while said pair of blades is being moved out of engagement with the material, and means for advancing the thus supported material forwardly of said blades.

18. Apparatus as defined in claim 17 wherein said means for supporting the material is carried by one of said blades.

19. A resin severing apparatus for accurately severing individual pieces from successively presented portions of a sheet-like body length of resin material which comprises, a support frame, a pair of cutting blades, a pair of cross-extending heads carried by said frame, one of said blades being carried by an associated one of said heads and the other of said blades being carried by an associated other of said heads, said pair of blades together defining a scoring pass for progressively presented end portions of the body length, a pair of electric heating elements carried by said heads for heating each of said blades to a resin-melting temperature, said one head carrying its associated said one blade to extend across said frame in a fixed position, said other head being movable on said frame and carrying its associated said other blade to extend across said frame in an aligned pass-defining relation with said one blade, fluid motor means carried by said frame and connected to said other head for moving said other blade into and out of an opposed pass-closing closely adjacent cutting-in position with respect to said one blade for forming opposed line recesses across a forward end portion of the body length, means cooperating with said other head for limiting its movement towards said first head to a position where the blades are in a close non-engaging aligned adjacency with respect to each other to retain a relatively thin connecting thickness portion across the body length, tie means operatively connecting opposite end portions of said other head to assure an equal inward movement of said other blade into an accurately aligned inward position with respect to said one blade, means positioned forwardly of said scoring pass for substantially retaining the main body of the material in a longitudinal in-line position while breaking-off a forward end portion thereof along said line recesses, and means for progressively advancing the body length in-line to the scoring pass and thereafter to the breaking-off position for successively severing forward end portions therefrom.

20. An in-line severing apparatus for effecting an improved cross-severance of individual pieces from progressively presented forward end portions of a sheet-like body length of solidified thermoplastic resin material which comprises, means for endwise-forwardly advancing the body length of material on a substantial horizontal plane, a support frame having a cooperative in-line position with respect to said advancing means, a pair of cooperatively positioned cross-extending blades operatively carried by said frame for defining a recess-forming pass therebetween for the body length, one head mounting one of said blades in a fixed position with respect to said frame, another and movable head mounting the other of said blades for forward movement into engagement with the body length to flex it across its width extent and into engagement with said fixed blade, means for applying melting heat to both of said blades and for simultaneously applying opposed cutting-in blade pressure along the lines of blade engagement with opposite sides of a forward end portion of the body length to form opposed aligned line recesses thereacross at the pass, means cooperating with said movable head for positively limiting the movement of said movable blade towards said fixed blade to a slightly separated fully aligned, opposed, line-recess-forming relation with the body length to complete application of recess-forming blade pressure and retain a relatively thin transverse thickness portion fully across the body length between the line recesses, said movable head being adapted to withdraw said other blade with respect to said one blade for releasing the body length, in-line means for advancing the body length from the recess-forming pass and cooling it along its line recesses, and a pass-forming separating means in an in-line advanced position with respect to the recess-forming pass for engaging opposite sides of the body length adjacent its line recesses to break-off the thin thickness portion thereof and complete separation of the forward end portion of the body length thereat.

* * * * *